US005535997A

United States Patent [19]

Croyle et al.

[11] Patent Number: 5,535,997

[45] Date of Patent: Jul. 16, 1996

[54] FABRIC PIECE AUTOMATIC FEEDER WITH SUCTION CUP PICKER AND TWISTED-BELT FLIPPER

[75] Inventors: Gene F. Croyle, Plano; E. Lennart Lindstedt, Richardson; Frederick N. Mueller, McKinney, all of Tex.

[73] Assignee: Levi Strauss & Co., San Francisco, Calif.

[21] Appl. No.: 74,782

[22] Filed: Jun. 10, 1993

[51] Int. Cl.[6] ..... B65H 5/08

[52] U.S. Cl. ..... 271/12; 271/106; 271/291; 271/186; 271/176; 271/303; 198/405

[58] Field of Search ..... 271/11, 12, 16, 271/20, 106, 107, 291, 176, 186, 5, 303; 198/395, 405, 399

[56] References Cited

U.S. PATENT DOCUMENTS

| | | | |
|---|---|---|---|
| 1,929,361 | 10/1933 | Liljebladh | 271/106 |
| 2,108,702 | 2/1938 | Backhouse | 271/20 |
| 3,280,995 | 10/1966 | Barkley | 198/405 |
| 3,314,676 | 4/1967 | Fromm | 271/106 |
| 3,523,687 | 8/1970 | Petersen et al. | 271/71 |
| 3,622,151 | 11/1971 | Range et al. | 271/74 |
| 3,838,771 | 10/1974 | Whiteford | 271/186 X |
| 3,913,906 | 10/1975 | Vits | 271/91 |
| 3,937,457 | 2/1976 | Schwebel | 271/92 |
| 4,002,332 | 1/1977 | Hoenigmann | 271/11 |
| 4,054,285 | 10/1977 | Stange et al. | 271/186 |
| 4,078,789 | 3/1978 | Kittredge et al. | 271/65 |
| 4,200,278 | 4/1980 | Gindri | 271/186 X |
| 4,226,324 | 10/1980 | Stocker | 198/405 |
| 4,346,880 | 8/1982 | Roller et al. | 271/186 |
| 4,451,191 | 5/1984 | Torre | 414/118 |
| 4,512,255 | 4/1985 | Crist | 101/230 |
| 4,526,361 | 7/1985 | DuBois | 271/186 |
| 4,566,686 | 1/1986 | Reist | 271/201 |
| 4,568,169 | 2/1986 | Wada et al. | 355/3 |
| 4,569,620 | 2/1986 | Lynch | 198/405 |
| 4,669,715 | 6/1987 | Jeschke | 271/186 X |
| 4,699,367 | 10/1987 | Russel | 271/65 |
| 4,720,227 | 1/1988 | Eberle | 271/106 X |
| 4,759,537 | 7/1988 | Illig et al. | 271/11 |
| 4,763,890 | 8/1988 | Zimmerman et al. | 271/30.1 |
| 4,799,613 | 1/1989 | Adamson | 198/395 |
| 4,968,021 | 11/1990 | Wafford et al. | 271/186 |
| 5,002,267 | 3/1991 | Brecy | 271/9 |
| 5,041,879 | 8/1991 | Akao et al. | 271/11 |
| 5,106,075 | 4/1992 | Wafford et al. | 271/186 |

FOREIGN PATENT DOCUMENTS

| | | | |
|---|---|---|---|
| 0047181A2 | 9/1980 | European Pat. Off. | 27/62 |
| 1109188 | 6/1961 | Germany | 271/106 |

OTHER PUBLICATIONS

Xerox Disclosure Journal, vol. 8, No. 5, p. 403, Sep./Oct. 1983.

*Primary Examiner*—H. Grant Skaggs
*Attorney, Agent, or Firm*—Medlen & Carroll

[57] ABSTRACT

A sheet feeder includes a pneumatic picker for picking the top sheet from a stack of sheets, and a flipper for inverting upside-down sheets. The picker has a row of suction cups, supplied with vacuum through hoses, for picking up the top sheet. The lip of each suction cup is inclined to the top surface of the stack at a fixed angle. If the angle is properly chosen, exactly one sheet will be picked up as the picker is moved onto and away from the stack. The inclined suction cups are for permeable materials such as cloth. The picked sheet may be inverted by a twisted-belt flipper if needed. The flipper has four rollers with axes in a rectangular configuration, and two twisted belts. Each belt is wrapped around a pair of rollers on opposite corners of the rectangle, and the belts run closely in between the far pairs. A sheet will be flipped as it travels through, held between the two belts. To select which sheets are to be flipped, a photocell and gate work to direct sheets into or around the flipper.

14 Claims, 3 Drawing Sheets

FABRIC PIECE AUTOMATIC FEEDER WITH SUCTION CUP PICKER AND TWISTED-BELT FLIPPER

FIELD OF THE INVENTION

The present invention relates to devices for picking a sheet of material from the top of a stack of sheets, and then flipping (inverting) the sheet if needed, for feeding the sheet into a sheet-processing machine right side up. This invention especially relates to such devices for picking up air permeable sheets such as pieces of cloth or fabric.

BACKGROUND OF THE INVENTION

In the manufacture of clothing it is often necessary to feed small sections or pieces of fabric into processing machines which edge, sew, and the like. For example, in making dungarees or, jeans, the rear seat patch pockets will first be cut as rectangles or polygons of denim, and then singly fed to a machine for hemming the top edge (prior to sewing the patch onto the pants to form the pocket). Or, one leg piece will be fed to a machine for sewing on a fly zipper tape.

Typically fabric pieces will be simultaneously cut from multiple layers, and arrive at the processing machine stacked. The stacks of fabric pieces may have individual pieces variously turned face up or face down; jeans fabric, for example, usually has a dark side and a light side, and the pieces must be fed into the hemming machine with the proper side up if the jeans are to be assembled correctly.

In the manufacture of jeans, pieces like pocket patches and fly material have traditionally been picked off from a stack manually and hand fed into the sewing or processing machine, because existing devices were unable to reliably perform the necessary operations, which are: first, picking up from the stack only the single top piece of fabric (to avoid feeding double pieces to the processing machinery); next, inspecting the pieces to determine whether the dark or light side is facing up; third, flipping those pieces which are wrongly oriented; and the fourth, feeding the individual pieces into the processing machine.

The prior art shows numerous devices for picking up layers or sheets of material from a stack. Many of these devices are designed for picking relatively stiff or inflexible materials like sheet metal or paper, and they cannot be used to pick cloth, which crumples easily, when compression forces parallel to its surface are used. Other devices known in the prior art, which use vacuum or air jets, are unsuited to picking up fabric because it is permeable to air flow.

The Bernoulli effect can be used to pick up a sheet of paper. This is disclosed by Zimmerman et al. in U.S. Pat. No. 4,763,890. Air is expelled from a linear array of nozzles across the surface of the top sheet in a stack. Reduced pressure resulting from the air velocity across the upper surface of the paper lifts the edge of the top sheet, which is then grasped by mechanical jaws. This technique, as disclosed by Zimmerman, may not work well with cloth due to the greater surface roughness which is a characteristic of cloth and may slow the sheet of air, the permeability of cloth which will lessen the pressure difference across the top sheet by air leakage, and also by cloth's tendency to flap which would make grasping by the jaws erratic.

Suction cups are widely used for picking up sheets of paper in printing presses and other devices. A suction cup is defined in the present specification, and in the following claims, as a hollow article having a lip for contacting a surface and for at least partially sealing against fluid leakage between the lip and the contacted surface. Suction or a partial vacuum inside the hollow of the cup causes ambient air pressure to force the cup against the contacted surface and so hold it by friction against the lip. Suction cups may have a closed hollow end, as in a child's rubber-tipped arrow, or may have their hollow ends connected to a vacuum source to supply suction. The latter type of suction cup is used in more machinery. Often the vacuum is valved for control of the suction force. Suction cups are almost always of resilient or rubbery material, both because this allows the lip to conform to surface irregularities and because the high coefficient of friction aids in picking up the sheet.

While suction cups are very useful for picking up sheets which are impermeable (e.g., sheet metal) or only somewhat porous (e.g., paper), they are generally ill-suited to removing stacked permeable sheets such as cloth or fabric workpieces, because of air leakage through the fabric. As a suction cup, with a partial vacuum in the cup, comes into contact with and covers the top sheet of a piece of fabric in a stack, air rushes through the permeable material of the top sheet; this air must also flow up through the adjacent sheet, second down in the stack, on its way to the topmost first sheet. The air flow through the resisting weave of the second sheet creates a pressure difference, and a force, which may pick up the second sheet as well as the top sheet.

The prior art does not show a suitable arrangement of suction cups for use in picking the single top sheet from a stack of permeable sheets.

Schwebel, in U.S. Pat. No. 3,937,457, teaches the use of suction cups axially mounted on the ends of swinging arms. His invention is intended to automatically align and/or stretch sheets as they are picked up from a stack. The arms are gimballed in two perpendicular directions, so that the suction cups are capable of ganged swinging in narrow arcs both in the direction of feed and also across it. The motion is limited by stops to narrow angles only. The arms are held in neutral positions by springs, and rock through their arcs as a result of friction between the suction cup lips and the top sheet. Schwebel discloses no active means of swinging the arms. The object of the Schwebel invention is to stretch a sheet, which would most likely result in wrinkles with most cloth or fabric.

U.S. Pat. No. 4,759,537, issued to Illig et al., shows a "suction pickup device" having a stem extending axially from a vacuum pipe. The stem terminates distal the vacuum pipe in a lip surrounding a hollow space connected to the vacuum pipe. The lip lies in a plane which is inclined to the common axis of the vacuum pipe and stem. The vacuum pipe moves axially toward and away from the surface of the top sheet of the stack for picking off sheets. The sheet stack top surface is inclined to the vacuum pipe/stem axis at the same angle as the lip plane is, so that the lip plane is always parallel to the stack surface, and the lip will lie flat on the top sheet when the pipe is extended to bring the lip and the top surface into contact. A vacuum is applied through the pipe and stem to hold the top sheet when contact is made.

The resilience of the stem is not discussed by Illig et al. The cross-hatching in his drawing indicates that the stem is made of resin or plastic material, but not of rubber or electrical insulation. Due to the fixed parallel orientation of the pipe/stem axis to the top sheet, the stem need not be resilient, or need be only minimally resilient.

Hoenigmann, in U.S. Pat. No. 4,002,332, shows a suction cup hingedly mounted at the end of a vacuum pipe for lifting metal sheets from a stack. The vacuum pipe and cup are moved, by a mechanism with perpendicular tracks attached to a frame, for lifting sheets from the top of the stack and feeding them into a machine. Unlike the Illig et al. invention, in which the entire arm pivots with the cup rigidly attached at the end, Hoenigmann's arm-like vacuum pipe member is non-rotating; the cup alone pivots. The pivot is apparently needed because the metal sheets will curve under their own weight and would break the seal without it. It appears that this pivot would not be needed to pick flexible cloth, which is easily held to the perimeter of a suction cup lip.

The prior art also shows devices for flipping over a sheet of material, but none of these is seen as being suitable for flipping a piece of fabric, such as denim.

The majority of disclosed flipping devices employ complex arrangements of parallel rollers, like those of printing presses. These flip a sheet by bending it in one dimension. See, for example, U.S. Pat. Nos. 4,346,880, 4,968,021, and 5,106,075. Such flippers are ill-suited to inverting cloth, which will bunch and jam in the rollers unless special tension means are employed to prevent it, as in a tape recorder drive. Also, any roller must reverse the direction of a sheet while inverting it, making roller devices ill-suited to flipping sheets travelling along a linear path.

U.S. Pat. No. 3,622,151, issued to Range, describes one device for linear-path flipping. His "fluidic flipover" apparatus for letter envelopes comprises a long and rather thin hollow box, which is twisted about its longest center line through an angle of 180 degrees. The interior of the box is pressurized with air. One side of the box, which is the envelope transport surface, is drilled with numerous air jet holes. The air holes are angled in the direction of transport. An envelope placed against the side of the box at one end is blown along the length of the box to the other end by the angled air jets.

The air jets levitate the letter near the surface for low friction. Air from the jets under the envelope must escape and flow outward from the letter perimeter: this means higher air velocity between the envelope and the box than between the envelope and the atmosphere, and so lower pressure by the Bernoulli effect. The higher atmospheric pressure holds the envelope onto the box surface.

As the envelope travels along the twisted transport surface it is likewise twisted through 180 degrees, and arrives at the far end of the box inverted.

The Range fluidic flipover is seen to be unsuitable for fabrics, because the force on the trailing edge of a piece of fabric will be greater than the force on the front edge. (The air jet impinges against the trailing edge but not the front edge.) Without paper's stiffness, the cloth would bunch, lose contact area, and blow off the track.

In sum, the prior art does not disclose any device or method for picking the top sheet from a stack of air-permeable, flexible sheets that is simple and inexpensive to implement, uses available parts, and is reliable. Neither is there disclosed a simple device for flipping flexible sheets transported linearly; nor is the prior art seen to teach any combination of devices suitable for picking and flipping fabric.

SUMMARY OF THE INVENTION

The present invention comprises, in combination, a suction cup picker and a twisted-belt flipper. The suction cup picker of the present invention employs a resilient, cylindrically symmetrical suction cup. A vacuum is pneumatically connected to the hollow interior of the cup for suction force. The suction cup is for lifting off the top sheet from a stack of sheets of flexible, air-permeable material such as cloth, woven fabrics, or felt materials.

For lifting larger sheets a linear array of two or more circular suction cups or one or more elongated suction cups may be employed, preferably in a line parallel to the leading edge of the top sheet. The suction cups are mounted on a mechanism which brings them simultaneously into contact with the top surface of the stack, and then moves up and/or forward to remove and feed forward the top piece picked up by the suction cups.

A key aspect of the present invention is that each cup is mounted at the same fixed angle relative to the top surface of the stack of sheets of pieces. The pick-up mechanism is such that this angle never changes while the suction cups are near the top surface. Thus, there is a fixed contact angle between the top surface of the stack and the planes of the suction cup lips.

As the suction cups are lowered together onto the surface by the mechanism, the lowermost points of the suction cup lips come into contact with the surface of the top fabric piece along a line, a short distance from the leading edge of the piece. The contact angle formed between the lips and the top surface opens in the forward feed direction. A vacuum pump sucks air into the hollows of the suction cups. The rushing air pulls the fabric leading edge upward. Due to the flexible nature of fabric, the top sheet will curl up and lie over the lips. This piece is now positively engaged by the device and ready to be picked up.

The lip/surface contact angle, the permeability, density and weight of the fabric, and the strength of the applied vacuum, are all important for proper functioning of the picker of the present invention. If the angle is too acute, more than one sheet of fabric will be picked up because of air moving up through the sheet under the top sheet. If the angle is too wide, the air velocity will be too low to pick up the top piece. In the preferred embodiment, using a particular vacuum source and suction cup arrangement to pick pieces of denim, the optimum contact angle has been found to be 40 degrees.

The mechanism on which the lips are mounted may include a lower surface generally level with the lowermost points of the lips. In one embodiment a breaker bar is mounted on this lower surface, with the bar extending parallel to the line of suction cups. When the breaker bar hits the stack it tends to separate the top piece from the next lower piece.

In still another embodiment, a layer of felt is adhered to the bottom of a stack bin which holds the sheets ready for pickup. If no felt or similar yielding material is provided at the bottom of the bin, the last few pieces of fabric, resting against the hard surface, will not respond to the impact of the breaker bar by separating properly. Preferably, the breaker bar and felt layer are combined in the present invention.

The twisted-belt flipper of the present invention consists of a pair of adjoining twisted belts. Each belt is wrapped about a respective pair of rollers. The four rollers' axes are all parallel to one another and perpendicular to the piece feed direction. The axes of the four rollers preferably define a rectangle. The rollers turn and the belts move to flip a sheet between them.

The belts may be designated first and second.

As seen from one side, the first belt is wrapped about the upper right and the lower left rollers, and is twisted through 180 degrees in passing between the two rollers. The second belt, wrapped around the upper left and lower right rollers, is twisted in exactly the same sense as is the first belt. The outside surfaces of the first and second belts are touching or closely adjacent in the transport region between the left and right pairs of rollers, but along the inner section only of each belt (the section running between the parts of each roller close to the adjacent roller).

The rollers are turned all in unison, in such respective senses of rotation so that the touching belt sections of the transport region move together from right to left. A fabric piece to be flipped enters between the entrance pair of rollers, which are cooperatively rotating in opposite senses and act as a nip pair. The piece is pulled in and held between the two adjacent belt sections by friction. As it is transported, it is also flipped because of the twist formed in the belts.

In the combination of the present invention, a photocell or other detector may be interposed between the pick-up and the flipper. The photocell will detect which side of a piece of denim is upward, by the darkness of the fabric surface. A feed gate responsive to the photocell can be used to guide into the flipper those pieces needing to be inverted. Pieces properly oriented are gated to a path which bypasses the flipper and sends them directly to the processing machine.

DETAILED DESCRIPTION OF THE PREFERRED EMBODIMENT

Figure 1:
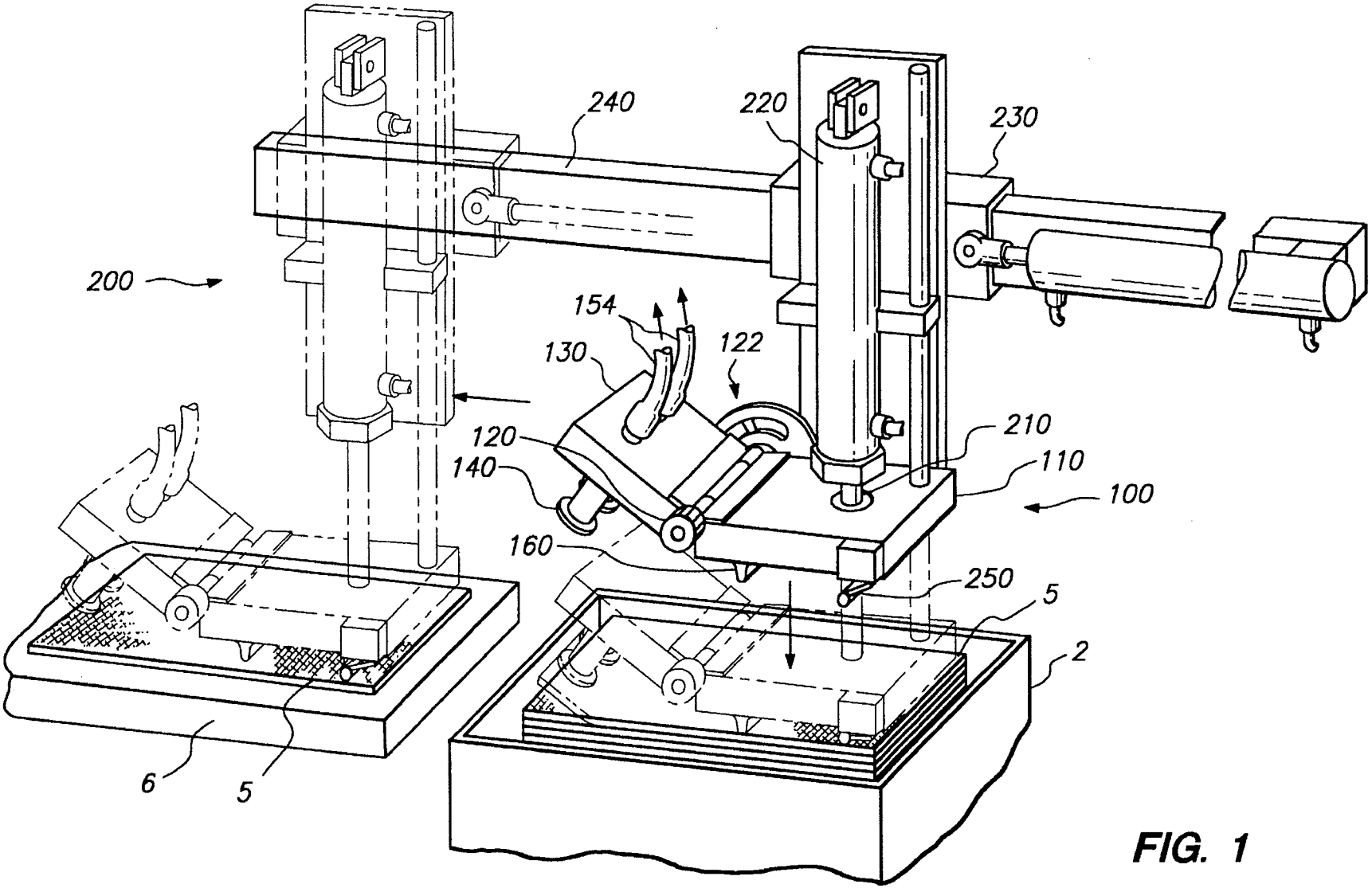
FIG. 1 is a perspective view of the picker of the present invention, showing a bin containing fabric sheets or workpieces; a picker, disposed above the bin, with suction cups for grasping the top sheet from the bin; a pick-up mechanism for moving the picker to remove sheets from the bin; and a transport table for moving the piece onward.
Figure 4:
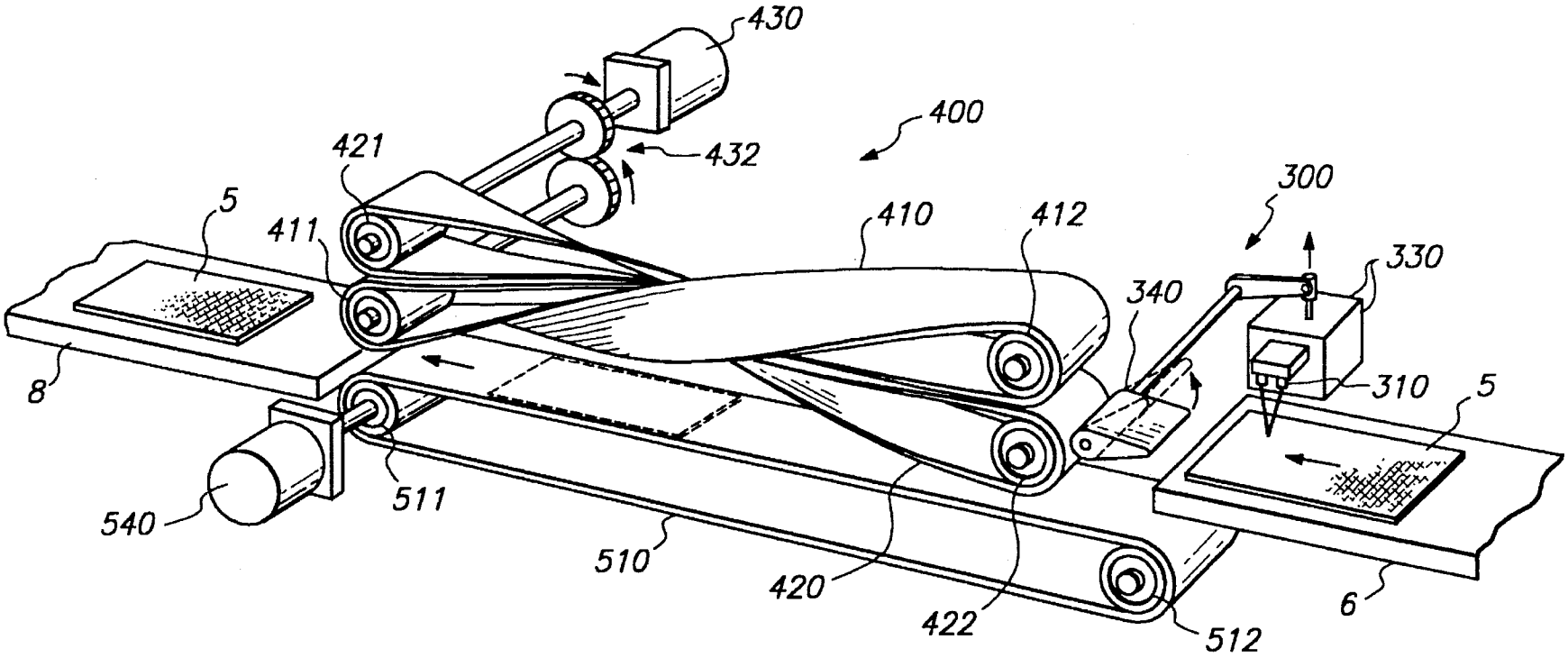
FIG. 4 is perspective view of the twisted belt flipper and associated devices. It shows, from right to left: the transport table also shown in FIG. 1, a photocell for detecting sheet orientation; a gate, responsive to the photocell, for selectively guiding pieces into or around a flipper; the flipper with its twisted belts for inverting the sheet; and another transport table.

The preferred embodiment of the present invention includes a combination picker and flipper for removing fabric sheet workpieces from a stack, inverting them if necessary, and transporting them on to a machine for further processing. FIG. 1 shows the first half of the invention, the picker, and FIG. 4 shows the second half, the flipper.

FIG. 1 shows a bin 2 containing sheets S of permeable material such as denim, other woven fabrics, felt materials, some papers, as well as any other suitable sheet material. The sheets S are picked up by a picker 100 which is movably mounted on a mechanism 200 for picking. The mechanism 200 lowers the picker 100, fixed at the end of the arm 210, onto the top surface of the stack of sheets S, where the picker pneumatically grasps the top sheet S. The arm 210 then retracts into the sleeve 220, and the slider 230 is caused to move to the left along track 240 to bring the picked-up top sheet S onto the transport table 6. The transport table 6 has conventional means, not shown, for moving the sheets S along to the left. One example of such means is spinning circular brushes which lightly brush the sheets forward. The table 6 may be replaced by a tunnel, belt arrangement, or any other means of transporting the sheets S, without affecting the scope of the invention. Besides the X-Y configuration shown here, other conventional mechanism means, with various geometries and power sources, may be used for the mechanism 200. The bin 2 may be one of a plurality of similar bins sequentially mounted on a track, carousel, or the like, for faster bin replacement.

The downward motion of the arm 210 is stopped by a sensor switch 250 which is connected electrically to a control system for the mechanism 200. The control mechanism (not shown) is conventional, and uses well-known methods and apparatus. Other conventional means of limiting the motion may also be employed. Also, the stack of sheets S may be raised within the bin by conventional devices to maintain the top surface of the bin stack at a constant position.

Figure 2:
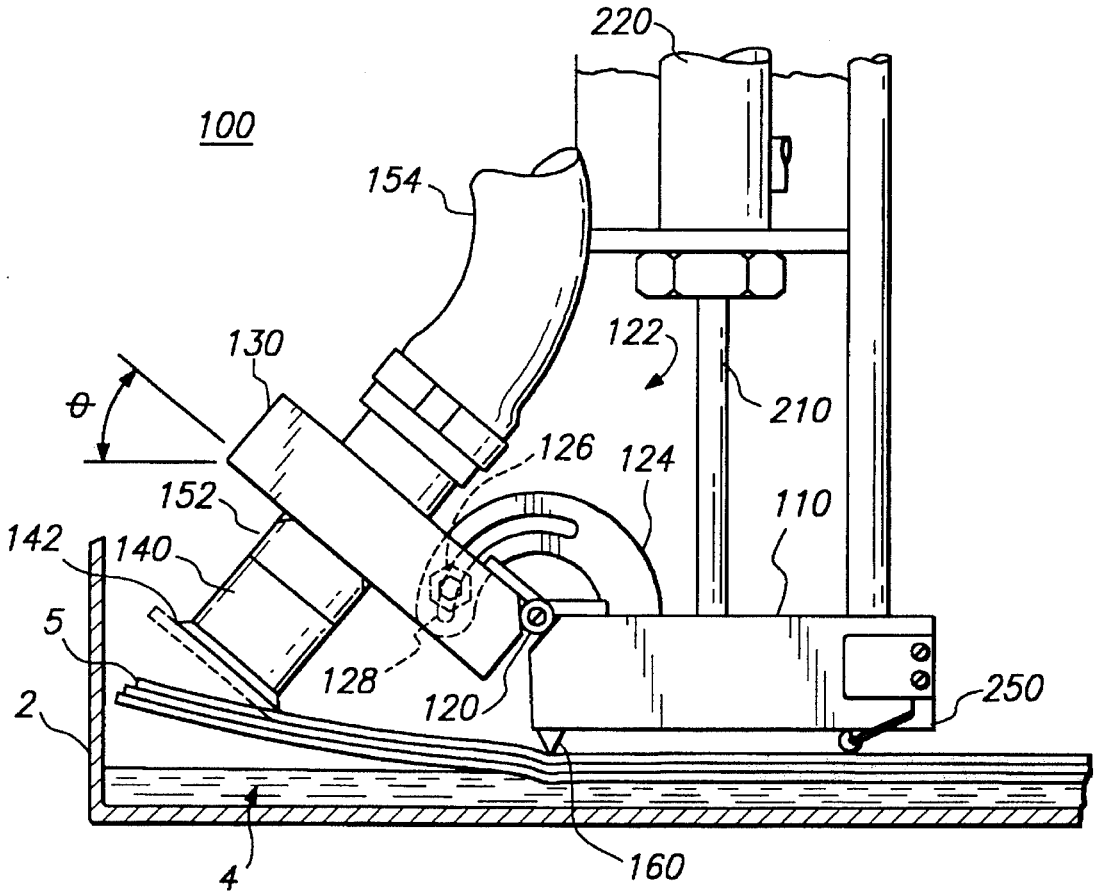
FIG. 2 shows in side elevation the picker of FIG. 1, with the bin and sheets in cross section.
Figure 3:
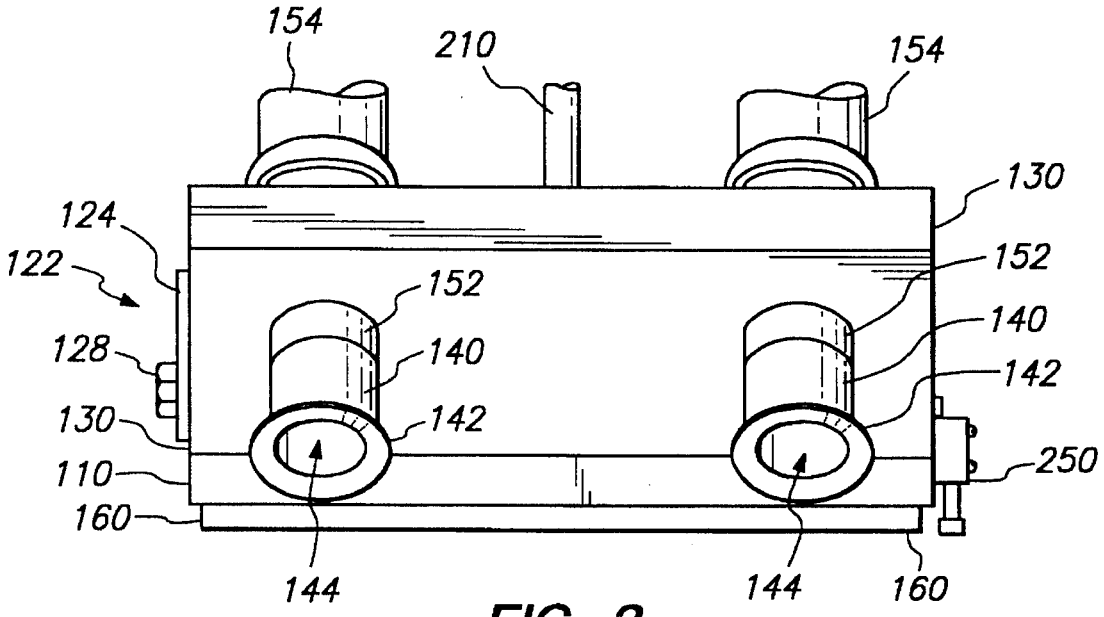
FIG. 3 shows the picker in frontal elevation view, with suction cups and breaker bar visible. The sheets and bin are not shown.

The picker 100 is also shown in FIGS. 2 and 3. It further comprises a base 110 connected by a hinge 120 to an inclined tilt plate 130. The hinge 1allows the angle θ (shown in FIG. 2) between the base plate 110 and the tilt plate 130 to be adjusted. A clamp 122 firmly locks the plates 110, 130 at the chosen angle θ, which does not vary as the picker 100 is moved by the mechanism 200 onto the top sheet S.

The clamp 122 may be of any sort. The clamp 122 shown in the figures employs a clamp plate 124 which is firmly bolted to the base plate 110, and a lock screw 126 which passes through an arcuate slot in the clamp plate 124 into a threaded hole 128 in the tilt plate 130. The lock screw 126 is tightened to hold the angle θ fixed.

Two suction cups 140 are mounted to the bottom of the tilt plate 130. The suction cups 140 are of the ordinary resilient, cylindrically symmetrical type. The lowermost edge or lip 142 of each suction cup 140 is preferably circular; both lips lie in a single plane, which is parallel to the tilt plate's upper and lower surfaces. This is best shown in FIGS. 2 and 3. Suction cups with non-circular lips, and lips which do not lie exactly in a plane, are within the scope of the present invention.

In other embodiments, a single suction cup 140, or a plurality of suction cups may be used. In an embodiment with a plurality of suction cups, it is preferable that the cups be set in a straight line with the lips all lying in a single plane if the picked end of the sheet S is straight. If the leading or forward edge of the sheets S were arcuate, then it might prove advantageous to have the lips lie generally on the surface of a cone, with the lowermost points of the lips 142 lying in a circle of a radius slightly less than the radius of the forward sheet edge. In the preferred embodiment, the suction cups 140 are all at the same level so that the lips of the several suction cups all contact the top sheet S at about the same time.

The suction cups 140 should be close to the front edge of the sheet S. The optimum distance for pickup can be determined, and the mechanism 200 arranged to set down the lip 142 of the suction cup 140 at the predetermined distance. If a plurality of suction cups 140 are employed, each preferably will be the same predetermined distance from the edge.

Each suction cup 140 is mounted by conventional means to a vacuum feed-through 152, which passes through the tilt plate 130 and connects to a vacuum hose 154, which in turn goes to a conventional suction source (not shown). The hollow space 144, shown in FIG. 3, within the lip 142 of each suction cup 140 is thus coupled to the vacuum source.

The hose 154 is flexible to allow for the motions of the picker 100 on the mechanism 200.

The angle θ is the contact angle at which the lip 142 contacts the top surface of the top sheet S. The contact angle θ is critical to the proper functioning of the picker 100. If the angle is too acute, then, for a given vacuum pressure, more than one sheet S may be picked up due to air flow through the top sheet S. If the contact angle θ is too large, then it is possible that no sheet S will be picked up. With the correct angle, just the one top sheet S is picked up, as desired.

When the sheets S are pieces of denim, it is preferred to use an angle θ of 40 degrees. In other embodiments, using various vacuum pressures, various workpiece sheet materials, and various suction cup sizes, shapes and materials, the best contact angle θ may be found by experimentation. The present invention is thus not limited to a contact angle θ of 40 degrees.

The present invention also includes within its scope not only the standard resilient suction cup 140, but also equivalent devices which include a hold-down part which can contact the sheet S, and a pick-up surface which simultaneously forms the contact angle with the sheet S. Thus, for example, a metal pipe section which had one portion defining the contact angle while partially resting on the surface, would be within the scope of the invention, and of the following claims.

The vacuum is released when the picker 100 has moved the sheet S onto the transport table 6. The sheet is moved along, and the picker 100 moves back to the bin 2 to pick the next sheet S from the stack.

Besides a vacuum pump, other means of producing a low pressure zone or partial vacuum in between the top surface and the suction cup 140 (or the lip 142) are also within the scope of the invention. The Bernoulli effect could be used, for instance: flapping of the edge would not prevent pickup if the flapping were small in amplitude. Motions of the suction cup 140 may also briefly induce partial vacuums.

A breaker bar 160 has been found to aid in separation of the sheets S in the bin 2 and helps the picker 100, pick up exactly one sheet. The breaker bar 160 extends from the bottom of the base 110 and runs parallel to the line of the suction cups 140.

The breaker bar 160 should not be positioned between the edge of the sheet S and the hold-down part of the suction cup, or it will clamp down the sheet S and prevent the suction cup from picking up the sheets. The breaker bar should therefore be positioned a pre-determined distance from the edge, that distance being no greater than the predetermined distance of the edge from the hold-down part of the suction cup lip 142.

When the bin 2 is almost empty, the breaker bar 160 will not work as well because of the unyielding bin bottom. To alleviate this problem, a layer 4 of felt, or similar yielding or resilient material, has been found to improve the pickup.

Referring now to FIG. 4, the continued path of the sheets S picked from the bin 2 is seen. The sheets S are selectively flipped over by the twisted-belt flipper 400, and then sent on the transport table 8 to the processing machine.

The transport table 6 (also seen in FIG. 1) carries the picked sheet S through a gate 300 which guides sheets S into or around the twisted-belt flipper 400, depending upon whether proper processing requires that they be inverted for further processing. Each sheet S, moving over the transport table 6, passes under a photocell 310 which detects which side of the denim is up, the light side or the dark side. The photocell 310 is coupled to a control device 330, which in turn activates a gate paddle 340. If the incorrect side of the sheet is up, the control device turns the gate paddle 340 to the position shown, and the sheet S is fed into the flipper 400. If the sheet S is correctly oriented, then the gate paddle is turned to guide the sheet downward onto a lower, non-inverting path 500. The control device 330 is conventional.

In the case of denim, for the preferred embodiment, the dark or blue side of the denim should be face up as it goes through the gate 300. Zipper tape is sewn on the blue or dark side while that side is facing up. If the light or white side is face up, the gate paddle 340 will guide the piece of denim onto the twisted-belt flipper 400 for inverting it so that the correct side is facing up.

The twisted-belt flipper 400 includes a first belt 410, a second belt 420, similar to belt 410, and lower cylindrical rollers 411, 412, 421, and 422, around which the belts 410, 420 are wrapped and over which they move. The rollers 411 and 421 are closely adjacent to cooperatively act as nip rollers and have mutually parallel axes of turning. Likewise, rollers 412 and 422 are closely adjacent to cooperatively act as nip rollers and have mutually parallel axes of turning.

The first belt 410 is wrapped about the upper right roller 412 and the lower left roller 411, and is twisted through 180 degrees in passing between the two rollers. The belt 410 is a flexible section of a cylinder, like a ring made by parallel cuts perpendicular to the length of a rubber hose. The twist is the same in both the outer section of the first belt 410 which travels from the bottom of the lower left roller 411 to the top of the upper right roller 412 when the flipper is operating, and in the inner section which travels from the bottom of the upper right roller 412 to the top of the lower left roller 411.

The second belt 420 is twisted in exactly the same sense of rotation as is the first belt, but it passes over the lower right roller 422 and upper left roller 421. The twist is again the same in the two sections, inner and outer, of the second belt 420 as it stretches between the rollers 421, 422, and this twist is in the same sense as the twist in the first belt 410. The inner section of the second belt 420 travels from the top of the lower right roller 422 to the bottom of the upper left roller 421, and the outer section travels from the top of the upper left roller 412 to the bottom of the lower right roller 422 when the flipper is operating.

Along the two inner sections of the belts 410, 420, the outside surfaces of the belts are touching or closely adjacent in the region between the left pair of rollers 411, 421 and the right pair of rollers 412, 422. An article such as the sheet S will be held between the belts 410, 420 in this region. Belts such as 410, 420 which lie close together are called "sandwich belts".

The rollers are powered to turn in such directions that a sheet S will be pulled between the rollers 412 and 422, moved along between the belts 410, 420, and ejected from between rollers 411, 421 onto the transport table 8. Any conventional means for turning the rollers or for moving the belts may be used. FIG. 4 shows a motor 430 and gears 432 for turning the rollers.

Here, and in the following claims, "sense of rotation" refers to either one of the two ways that something can twist. These two senses can be denoted as "clockwise" and "counterclockwise", once an appropriate reference direction has been defined. In the present invention, as depicted in the drawing FIG. 4, if the direction of transport of the sheets is taken as the reference direction, then the twists of both the first and second belts are counter-clockwise.

Because 180 degrees clockwise and 180 degrees counter clockwise yield the same result, an inversion or flip, the sense of rotation need not be defined in those of the following claims which read on an inversion of the sheet through a rotation angle of 180 degrees. Either of the two senses of rotation will achieve the same result.

The present invention may also rotate sheets through angles less than or greater than 180 degrees. The amount of turning of an article fed between the belts is equal to the angle which the axes of the rollers 411, 421 make with the axes of the rollers 412, 422.

The belts and roller surfaces may be complementarily ribbed in the manner of auto engine drive shaft belts, or have other means for preventing slipping, should the application demand this. Likewise, the outer surfaces of the belts may be textured with ribs, nubs, waves, fingers, etc., or, these surfaces may have complementary mating patterns such as gear-like teeth for driving the and/or meshing the belts together.

A parallel, non-inverting transport path 500 includes a lower belt 510 running over rollers 511, 512, and a motor 530 for driving the belt 510. Sheets S are directed to this path if they are correctly oriented. Equivalent conventional transport path means may also be used.

It is to be understood that the designations "right", "left", "upper" and "lower" above, are terms used for clarity of description in relating positions of elements when the invention is in one particular orientation, and do not limit the present invention to a particular orientation in space either for mounting or for use. These terms are exemplary only. In the following claims, the "left", "right" terminology is avoided. The claims will be understood to describe the preferred embodiment illustrated and described as well as a mirror image of that particular embodiment, and others.

In general, the present invention is not limited in scope to the particular embodiment described above.

We claim:

1. An apparatus for feeding limp sheets of fabric workpieces from a stack of fabric workpieces comprising:

a. a picker for removing a top fabric workpiece sheet from a stack of fabric workpiece sheets, the stack having a generally flat upper surface wherein the top sheet lies, the picker comprising:

hold down means for contacting the top fabric workpiece sheet a first predetermined distance from a leading edge of the top sheet;

a pick-up surface oriented at an acute contact angle to the top fabric workpiece sheet and positioned between the hold down means and the leading edge; and means for forming a low pressure zone between the top sheet and the pick-up surface for drawing a portion of the top sheet between the hold down means and the edge into contact with the pick-up surface; and b. a fabric workpiece sheet flipper for inverting a fabric workpiece sheet fed from the picker, the flipper comprising:

a pair of sandwich belts positioned to receive the leading edge of the fabric workpiece sheet, wherein the fabric workpiece sheet has a face up orientation relative to gravity, the pair of sandwich belts having:

a continuous conveyor first belt; and a continuous conveyor second belt oriented adjacent to the first belt to act cooperatively therewith for drawing the fabric workpiece sheet therebetween, and further wherein the first belt and the second belt are jointly twisted through a same angle for rotating the fabric workpiece sheet 180 degrees about an axis which is parallel to the direction of travel of the fabric workpiece sheets whereby the fabric workpiece sheets will be inverted to a face down position and the leading edge will remain the leading edge as the fabric workpiece emerges from the flipper.

2. The apparatus according to claim 1, wherein the hold down means and the pick-up surface are integrally formed in a single device.

3. The apparatus according to claim 2, wherein the single device comprises a resilient suction cup having a substantially planar lip, the lip including a first lip surface comprising the pick-up surface and a second lip surface comprising the hold down means.

4. The apparatus according to claim 3, further comprising a mechanism for selectively bringing the suction cup into contact with the top sheet at the contact angle.

5. The apparatus according to claim 4, further comprising breaker bar means for striking the top sheet a second predetermined distance from the edge.

6. The apparatus according to claim 3 wherein said single device comprises a plurality of the suction cups.

7. The apparatus according to claim 6, wherein the pick-up surfaces of the suction cups are all equidistant from the edge.

8. The apparatus according to claim 1, wherein the means for forming a low pressure zone comprises a vacuum source coupled to a suction cup.

9. The apparatus according to claim 1, wherein the same angle through which the belts are jointly twisted is 180 degrees, whereby the sheet ejected therefrom has a face down orientation.

10. The apparatus according to claim 9, further comprising:

a. a non-inverting path parallel to the flipper;

b. a sheet orientation sensor; and c. a gate responsive to the sensor for selectively guiding the sheet to the flipper and to the non-inverting path.

11. The apparatus according to claim 1, further comprising a first pair of rollers over which the first belt is disposed, and a second pair of rollers over which the second belt is disposed.

12. A fabric workpiece sheet feeding apparatus comprising:

a. sheet picker for removing a top sheet of a stack of flexible airpermeable fabric workpiece sheets, the stack having a generally flat upper surface whereon the top fabric workpiece sheet lies; the picker comprising:

a resilient suction cup, a mechanism for moving the suction cup into contact with and away from the upper surface to remove the top fabric workpiece sheet therefrom, the suction cup tilted relative to the upper surface;

whereby a vacuum source may be connected to the suction cup so that the top fabric workpiece sheet may cling to the suction cup and be picked up, and the mechanism may move the top fabric workpiece sheet held to the suction cup away from the stack for feeding; and b. a flipper for inverting a fabric workpiece sheet fed from the picker, comprising:

a pair of input nip rollers, for receiving the leading edge of the fabric workpiece sheet having a face up orientation, including a first roller and a second roller;

a pair of output nip rollers, coupled to receive the leading edge of the fabric workpiece sheet from the input rollers, including a third roller and a fourth roller;

a continuous conveyor first belt mounted to the first roller and the third roller;

a continuous conveyor second belt mounted to the second rollers and the fourth roller to cooperatively act with the first belt and thereby form a pair of sandwich belts wherein the first belt and the second belt are jointly twisted through a same angle for rotating the fabric workpiece sheet 180 degrees about an axis parallel to the direction of travel of the fabric workpiece sheets whereby the fabric workpeice sheet will be inverted to a face down position and the leading edge emerges first from the flipper.

13. The apparatus according to claim 12, further comprising:

a. a non-inverting path parallel to the flipper;

b. a sheet orientation sensor; and c. a gate responsive to the sensor for selectively guiding the fed sheet to the flipper and to the non-inverting path.

14. The flipper apparatus according to claim 12, wherein the same angle through which the belts of said flipper are jointly twisted is 180 degrees.

* * * * *

UNITED STATES PATENT AND TRADEMARK OFFICE

CERTIFICATE OF CORRECTION

PATENT NO. : 5,535,997

DATED : July 16, 1996

INVENTOR(S) : Gene F. Croyle *et al.*

It is certified that error appears in the above-indentified patent and that said Letters Patent is hereby corrected as shown below:

At col. 6, line 21, please delete "1" and insert --120--.

Signed and Sealed this

Twenty-ninth Day of October 1996

*Attest:*

Bruce Lehman

BRUCE LEHMAN

*Attesting Officer*

*Commissioner of Patents and Trademarks*